US008689509B2

(12) United States Patent
Gleeson et al.

(10) Patent No.: US 8,689,509 B2
(45) Date of Patent: Apr. 8, 2014

(54) EXPRESSED JOINT FACADE SYSTEM

(75) Inventors: James Gleeson, North Curl Curl (AU); Jesper G. Jensen, Peakhurst (AU)

(73) Assignee: James Hardie Technology Limited, Dublin (IE)

( * ) Notice: Subject to any disclaimer, the term of this patent is extended or adjusted under 35 U.S.C. 154(b) by 667 days.

(21) Appl. No.: 12/278,085

(22) PCT Filed: Feb. 1, 2007

(86) PCT No.: PCT/AU2007/000096

§ 371 (c)(1),
(2), (4) Date: Aug. 1, 2008

(87) PCT Pub. No.: WO2007/087681

PCT Pub. Date: Aug. 9, 2007

(65) Prior Publication Data

US 2009/0019814 A1 Jan. 22, 2009

(30) Foreign Application Priority Data

Feb. 3, 2006 (AU) ..... 2006900528

(51) Int. Cl.
*E04C 3/00* (2006.01)
*E04D 1/36* (2006.01)

(52) U.S. Cl.
USPC ..... 52/461; 52/390; 52/287.1; 52/387; 52/468; 52/281; 52/483.1

(58) Field of Classification Search
USPC ..... 52/182, 188, 190, 461, 468, 390, 287.1, 52/506.01, 235, 386, 387, 281, 483.1, 52/716.8
See application file for complete search history.

(56) References Cited

U.S. PATENT DOCUMENTS

| | | | |
|---|---|---|---|
| 1,630,801 | A | 5/1927 | Parsons |
| 1,698,557 | A | 1/1929 | O'Brien |
| 3,481,093 | A | 12/1969 | Davidson |
| 3,869,295 | A | 3/1975 | Bowles et al. |
| D237,269 | S | 10/1975 | Edwards |
| D237,271 | S | 10/1975 | Edwards |
| 3,986,312 | A | 10/1976 | Calhoun et al. |
| 4,052,829 | A | 10/1977 | Chapman |

(Continued)

FOREIGN PATENT DOCUMENTS

| | | |
|---|---|---|
| AU | 90831 | 8/1985 |
| AU | 95374 | 2/1987 |

(Continued)

OTHER PUBLICATIONS

Decision of Opposition in relation to Taiwanese Patent Application No. 85114421 (corresponding to US Patent No. 6,510,667), issued Aug. 3, 1998.

(Continued)

*Primary Examiner* — Chi Q Nguyen
(74) *Attorney, Agent, or Firm* — Knobbe, Martens, Olson & Bear, LLP

(57) ABSTRACT

A panelized cladding system including a plurality of battens securable to a building structure, each batten having a structure engaging surface and an integrally formed finish ready panel supporting surface, and fiver cement cladding panels secured to or through the battens such that the finish ready panel supporting surface of each batten forms an external recessed surface of an express joint formed thereon.

25 Claims, 5 Drawing Sheets

(56) References Cited

U.S. PATENT DOCUMENTS

| | | | | | |
|---|---|---|---|---|---|
| 4,068,434 | A | * | 1/1978 | Day et al. | 52/220.1 |
| 4,074,141 | A | * | 2/1978 | Bryant | 250/517.1 |
| 4,076,884 | A | | 2/1978 | Riley et al. | |
| 4,114,334 | A | * | 9/1978 | Thoren | 52/302.3 |
| 4,194,336 | A | * | 3/1980 | Weinar | 52/481.1 |
| 4,265,061 | A | * | 5/1981 | Sweet et al. | 52/93.2 |
| 4,275,534 | A | * | 6/1981 | Porter | 52/82 |
| 4,366,657 | A | | 1/1983 | Hopman | |
| 4,373,957 | A | | 2/1983 | Pedersen et al. | |
| 4,516,373 | A | * | 5/1985 | Osawa | 52/387 |
| 4,651,484 | A | * | 3/1987 | Rutkowski | 52/241 |
| 4,680,911 | A | | 7/1987 | Davis et al. | |
| 4,854,095 | A | * | 8/1989 | Michlovic | 52/235 |
| 4,895,598 | A | | 1/1990 | Hedberg et al. | |
| 4,963,430 | A | | 10/1990 | Kish et al. | |
| 5,117,600 | A | | 6/1992 | Yerushalmi et al. | |
| 5,242,736 | A | | 9/1993 | Van Erden et al. | |
| 5,397,631 | A | | 3/1995 | Green et al. | |
| 5,622,556 | A | | 4/1997 | Shulman | |
| 5,724,783 | A | | 3/1998 | Mandish | |
| 5,732,520 | A | | 3/1998 | Maietta | |
| 5,736,594 | A | | 4/1998 | Boles et al. | |
| 5,918,437 | A | * | 7/1999 | Dobija | 52/506.01 |
| 5,960,598 | A | | 10/1999 | Tamlyn | |
| 5,974,748 | A | | 11/1999 | Sciuga et al. | |
| 6,018,924 | A | | 2/2000 | Tamlyn | |
| 6,030,447 | A | | 2/2000 | Naji et al. | |
| 6,155,014 | A | * | 12/2000 | Wagner | 52/281 |
| 6,341,458 | B1 | | 1/2002 | Burt | |
| 6,510,667 | B1 | | 1/2003 | Cottier et al. | |
| 6,516,580 | B1 | | 2/2003 | Maietta | |
| 6,571,523 | B2 | * | 6/2003 | Chambers | 52/309.2 |
| 6,682,814 | B2 | * | 1/2004 | Hendrickson et al. | 428/326 |
| 6,758,017 | B2 | | 7/2004 | Young | |
| 2002/0073638 | A1 | | 6/2002 | Kunz et al. | |
| 2004/0020143 | A1 | | 2/2004 | Webb | |
| 2004/0118076 | A1 | | 6/2004 | Bezubic | |
| 2006/0005489 | A1 | | 1/2006 | Smythe | |
| 2006/0010800 | A1 | | 1/2006 | Bezubic | |
| 2008/0216430 | A1 | | 9/2008 | Gleeson et al. | |
| 2009/0064599 | A1 | | 3/2009 | Bennett | |

FOREIGN PATENT DOCUMENTS

| | | | |
|---|---|---|---|
| AU | 99315 | | 1/1988 |
| AU | 105706 | | 10/1989 |
| AU | 109294 | | 10/1990 |
| AU | 112156 | | 9/1991 |
| AU | 112157 | | 9/1991 |
| AU | 122184 | | 12/1994 |
| AU | 124159 | | 7/1995 |
| AU | 128989 | | 1/1997 |
| AU | 745114 | | 12/1998 |
| AU | 136553 | | 3/1999 |
| AU | 143709 | | 5/2001 |
| AU | 783430 | | 6/2001 |
| AU | 735352 | | 7/2001 |
| AU | 2001287356 | | 4/2002 |
| AU | 148950 | | 8/2002 |
| AU | 2003204739 | B2 | 7/2003 |
| AU | 2003257906 | A1 | 7/2004 |
| AU | 310645 | | 10/2006 |
| CA | 974726 | | 9/1975 |
| DE | 2440497 | | 3/1976 |
| EP | 0024360 | | 3/1981 |
| EP | 0074338 | | 3/1983 |
| EP | 0305209 | | 3/1989 |
| EP | 0430667 | | 6/1991 |
| GB | 558239 | | 12/1943 |
| GB | 564447 | | 9/1944 |
| GB | 1174902 | | 12/1969 |
| GB | 1590875 | | 6/1981 |
| GB | 1086311 | | 3/2001 |
| GB | 2378192 | | 2/2003 |
| JP | 06278116 | A | 10/1994 |
| JP | 08004248 | | 1/1996 |
| JP | 08068184 | A2 | 3/1996 |
| JP | 10280639 | | 10/1998 |
| JP | 11256683 | | 9/1999 |
| JP | 2000064554 | A2 | 2/2000 |
| JP | 2002161623 | A2 | 6/2002 |
| JP | 200716428 | | 1/2007 |
| NZ | 334899 | | 4/2000 |
| NZ | 335529 | | 12/2000 |
| NZ | 502017 | | 1/2001 |
| NZ | 525507 | | 9/2004 |
| NZ | 536129 | | 2/2006 |
| TW | 278536 | | 6/1996 |
| TW | 278537 | | 6/1996 |
| TW | 282800 | | 8/1996 |
| WO | WO-8102758 | | 10/1981 |
| WO | WO-9324711 | | 12/1993 |
| WO | WO-9708111 | | 3/1997 |
| WO | WO-9964692 | | 12/1999 |
| WO | WO-02096824 | | 12/2002 |
| WO | WO-03035998 | A1 | 5/2003 |
| WO | WO-2004087412 | A1 | 10/2004 |
| WO | WO-2005003478 | | 1/2005 |
| WO | WO-2005035900 | | 4/2005 |
| WO | WO-2005068741 | | 7/2005 |
| WO | WO-2005078210 | A1 | 8/2005 |

OTHER PUBLICATIONS

Decision of Appeal in relation to Taiwanese Patent Application No. 85114421 (corresponding to US Patent No. 6,510,667), issued Feb. 24, 1999.

Simplicity Tool Corporation, "Off Stud Joiners," May 12, 2009, 1 p. (US).

Simplicity Tool Corporation, "Installation Instruction for Off Stud Joiners," May 12, 2009, 1 p. (US).

Certainteed WeatherBoards™ Fiber Cement Siding, "Lap Siding Installation Guide," Oct. 2008, 8 pp.

BGC Fibre Cement, "Duraplank™ Technical Information for Duraplank™ Woodgrain and Smooth for External Cladding,", Apr. 2007, 12 pp.

James Hardie®, "External Cladding—Technical Specification," Sep. 2005, 32 pp.

James Hardie®, "Scyon™ Stria™ Cladding Installation Instructions," Jun. 2008, 6 pp.

U.S. Appl. No. 29/324,083, filed Sep. 5, 2008 entitled "Building Element" first-named Inventor: Darren Southwell.

Eternit Building Materials, "Glasal Fibre Cement Cladding Panels" May 2003, 8 pp.

Eternit Building Materials, "Omega and Zeds" May 2003, 8 pp.

U.S. Appl. No. 29/324,087, filed Sep. 5, 2008 entitled "Building Element" ; first-named Inventor: Darren Southwell.

International Search Report dated Mar. 29, 2007 in Co-Pending International PCT Application No. PCT/AU2007/000096.

New Zealand Building Code Acceptable Solution E2/AS1, Department of Building and Housing Jul. 1, 2005 (retrieved on Mar. 22, 2007) Retrieved from the internet <URL http://www.minhousing.govt.nz/UserFiles/File/Publications/Building/Compliance-documents/clause-e2-b.pdf (37 pages).

Scyon™ Matrix™ website printed Sep. 13, 2006 at http://www.jameshardie.com.au/Products/Scyon/Cladding/Matrix/default.htm.

Scyon™ Axon™ website printed Sep. 13, 2006 at http://www.jameshardie.com.au/Products/Scyon/Cladding/Axon.

Scyon™ Linea™ website printed Sep. 13, 2006 at http://www.jameshardie.com.au/Products/Scyon/Cladding/Linea/default.htm.

* cited by examiner

EXPRESSED JOINT FACADE SYSTEM

FIELD OF THE INVENTION

The present invention relates to an expressed joint panelized cladding or facade system using panels formed predominantly from fibre cement. The system has been designed primarily for use in residential dwelling. However, it will be appreciated that the invention is not limited to such application.

BACKGROUND TO THE INVENTION

Expressed joint panelized facade systems, having a pattern of discrete panels with feature joints formed therebetween, have been extensively used in commercial building applications. Fibre cement has been favoured as one of the preferred panel materials, as it is relatively durable, inexpensive, and allows a variety of finishes to be applied directly to the board either on-site or through pre-finishers.

Up until recently, all expressed joint fibre cement facade panel systems were specifically designed for the commercial market and usually comprised large sized high density panels that are installed on specially designed complex metal support framing structures. These framing systems comprise numerous components including joining battens, intermediate battens, sealing strips, corner brackets, window and door opening fixtures and the like.

Recent architectural trends have moved towards creating a similar expressed joint panelized cladding finish for residential properties. However, the majority of existing commercial systems have a structural design, in relation to both the panel and the supporting framing system, which is excessive for residential construction. This makes them generally cost prohibitive, or at least uncompetitive, when compared to other residential wall building and finishing techniques. Furthermore, the need to specify, use and source a wide variety of different fixing and sealing elements in each installation, makes the commercial systems unattractive to builders working in the residential market.

While there has been some recent attempt to provide alternative systems specifically configured for the residential market, these have generally comprised simply a lighter weight version of existing commercial systems, using thinner facade panels and similar but lighter weight metal support framing components made from a thinner gauge steel. Sealing strips and various specialty components for corners and windows and door openings are still required. As such, the component cost of these new residential facade systems may still be relatively expensive and most importantly are still fairly complex and thereby costly and time consuming to install.

It is an object of the present invention to provide an expressed joint panellised cladding system, an expressed joint clad wall and method of construction of an expressed joint clad wall that is particularly suited to the residential building market and which overcomes or ameliorates one or more of the above-discussed disadvantages of the prior art or which offers at least a useful alternative thereto.

SUMMARY OF THE INVENTION

According to a first aspect of the invention there is provided an expressed joint panelized cladding system including:

a plurality of battens securable to a building structure, each batten having a structure engaging surface and an integrally formed finish ready panel supporting surface; and one or more fibre cement cladding panels;

the panels being securable directly to or through the battens such that said finish ready panel supporting surface of each batten may form an external recessed surface of an expressed joint formed thereon.

The term "integrally formed finish ready surface" is used herein to refer to a surface that is at least partially weather resistant (either by treatment such as coating, painting or by virtue of inherent material properties) and is either fully finished or ready for optional further finishing, such as painting, if required.

Preferably, the fibre cement cladding panels have sealed front and rear surfaces. In particularly preferred forms, the cladding panels are sealed on all six sides.

Desirably the battens are made from a non-metallic, preferably nailable, material.

Most preferably the battens are made from a low density nailable fibre cement.

In at least one preferred form, the batten is of sufficient thickness and has sufficient nail holding properties, such that once the batten has been secured to the underlying building structure using appropriate fasteners, the panels can be supported solely by attachment to the battens. In other embodiments, a thinner batten may be used and the panels secured by means of fasteners that extend through the battens and into the underlying building structure.

Desirably, the majority of battens are secured vertically to the building structure so as to allow for natural drainage through the gap formed therebetween. In such cases a plurality of thin backing strips may be provided for creating a sealable horizontal external recessed surface of an expressed joint spanning between the battens. Alternatively, the battens can be secured horizontally using additional framing support where required, and further battens or backing strips used to define additional joint surfaces as required.

In one form the building structure comprises a building frame made preferably from timber or steel. However, the system is adaptable to other building structures such as brickwork or concrete blocks or panels.

According to another embodiment there is provided a panel supporting batten in the form of a longitudinal nailable fibre cement strip having a building structure engaging surface and a panel supporting surface, the batten being finish ready (as defined above) on at least its panel supporting surface so that it is ready for painting as and if required. In one form, the fibre cement is finish ready by means of a suitable surface coating. Other embodiments may rely on the inherent weather resistance of most fibre cement formulations or use a modified formulation with enhanced weather proofing properties.

Preferably, the fibre cement is a low density nailable fibre cement.

Desirably, the batten has a thickness of at least 18 mm and a width of about 40 mm to 100 mm. Most preferably, the width range is 45 mm to 70 mm. Desirably, the batten is made from fibre cement having a density range of approximately 0.8 to 1.3 g/cc and more preferably 0.8-1.2 g/cc. Optionally, the fibre cement has a composition that includes density modifiers such as: inorganic hollow or foamed microparticles and all other additives as disclosed in WO 01/68547 the entirety of which is incorporated herein by reference; calcium silicate hydrate; entrained air and other suitable density reducing additives, or any combination thereof.

In the preferred form the expressed joint panelized cladding system of the first aspect includes battens in accordance with the second aspect.

In accordance with a third aspect of the invention there is provided an expressed joint panelized clad wall including:

a building structure;

a plurality of battens secured to the building structure, each batten having a structure engaging surface and an integrally formed finish ready panel supporting surface;

one or more fibre cement cladding panels secured directly to or through the battens;

the panels being disposed such that said finish ready panel supporting surface of at least some of said battens forms an external recessed surface of an expressed joint formed thereon.

Desirably, the panels have sealed front and rear surfaces.

Preferably, the building structure comprises a frame that is nailable and preferably made of timber and the battens are made of a nailable material, most preferably a nailable fibre cement.

Preferably, a suitable drainage plane such as a building wrap, rigid barrier, foil or sarking is secured to the building structure underneath the battens.

Where the structure is a timber frame the battens may be nailed through the drainage plane to the timber building frame therebelow.

In the preferred form, the fibre cement cladding panels are also preferably made of a nailable fibre cement and are connected to the battens using impact fasteners such as nails or staples, most preferably using a small head finishing style nail such as a T-head Brad nail or flat head nail or equivalent. Alternatively, the fibre cement cladding panels may be connected to the battens using a suitable adhesive which may also serve as a sealant. In other forms, the panels are secured to the battens using screws or a combination of impact fasteners (including finishing style nails) and adhesive.

In another embodiment using a steel frame, the battens are secured to the frame using suitable fasteners such as self drilling screws and the fibre cement panels are then secured to the battens by any of the appropriate means discussed above.

In accordance with a fourth aspect of the invention there is provided a method of constructing an expressed joint panelized clad wall, said method including the steps of:

erecting a building structure;

securing a plurality of battens to the building structure, each batten having a structure engaging surface and an integrally formed finish ready panel supporting surface; and securing one or more fibre cement cladding panels directly to or through the battens;

whereby the panels are positioned such that said finish ready panel supporting surface on at least some of said battens forms an external recessed surface of an expressed joint formed thereon.

Preferably the method includes the step of connecting a suitable drainage plane such as a building wrap, rigid barrier, foil, waterproof coating or sarking to the building structure prior to securing the battens.

In the preferred form, the building structure comprises a frame made from timber and the battens are made of fibre cement in accordance with the second aspect of the invention. In this embodiment, the battens are secured to the frame using suitable impact fasteners such as fibre cement nails or any other suitable fasteners.

Preferably, the fibre cement cladding panels are sealed on front and rear surfaces and desirably are also of a nailable form and secured to the underlying fibre cement battens by means of finishing nails such as flat head nails or T-head brad nails. Optionally, an adhesive may also be used with the finishing nails, the adhesive also optionally acting as a sealant.

In the most preferred form, nailable fibre cement battens are secured to the vertical frame members and the method further comprises the step of attaching backing strips along the horizontal edges of the panels, at least along those edges where there will be no underlying batten. In one form, the backing strip is a thin metal or polymeric strip optionally pre-connected to the rear sealed face of the FRC panel by means of an adhesive or a double-sided adhesive tape or other securing mechanism. These backing strips may be pre-finished or the exposed portion can be painted after installation.

BRIEF DESCRIPTION OF DRAWINGS

A preferred embodiment of the invention will now be described, by way of example only, with reference to the accompanying drawings in which.

DETAILED DESCRIPTION OF THE INVENTION

Figure 1:
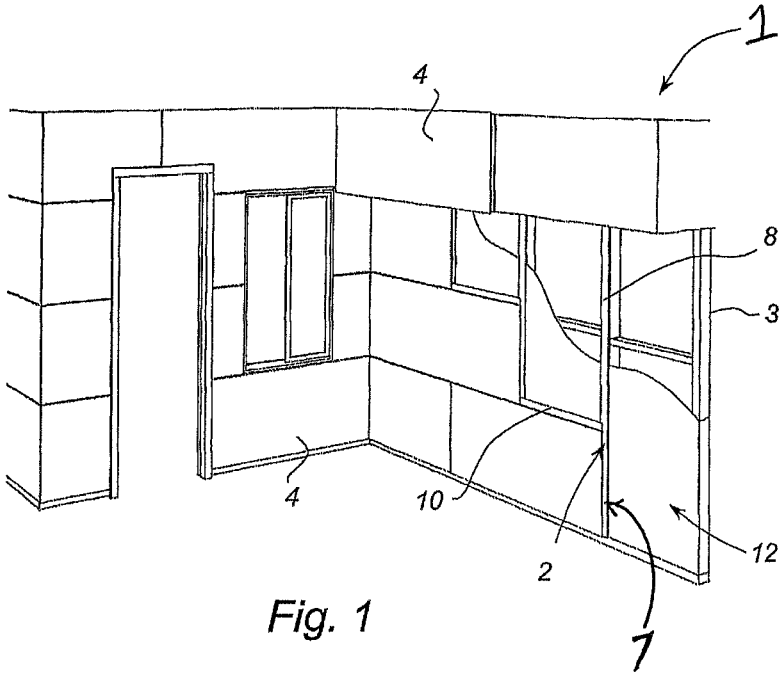
FIG. 1 is a perspective schematic view of a portion of a residential dwelling having the expressed joint panelized cladding system of the invention attached thereto.
Figure 2:
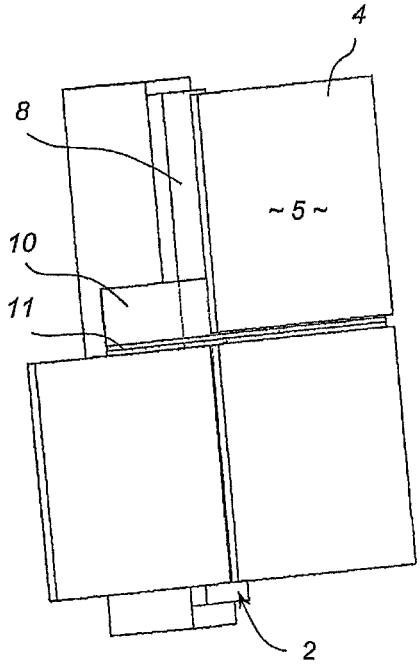
FIG. 2 is a perspective part view of the cladding system shown in FIG. 1, illustrating three panels and the underlying components and structure.
Figure 3:
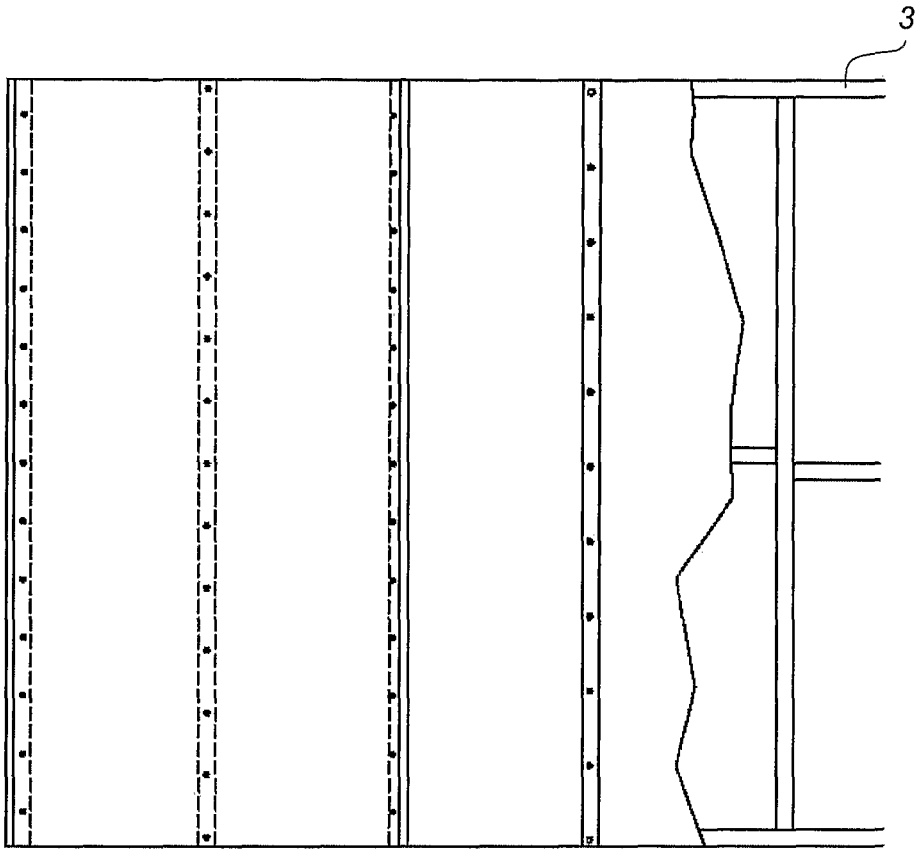
FIG. 3 is a front view of a wall structure according to the invention illustrating typical wall fixing configurations.
Figure 4:
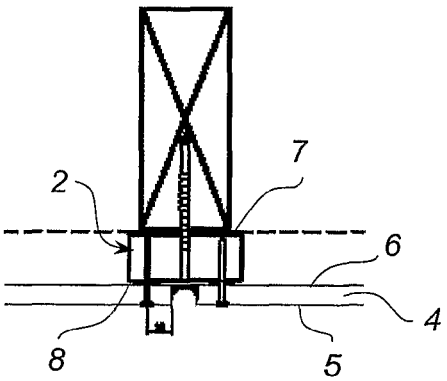
FIG. 4 is a sectional part view illustrating securing details of a vertical expressed joint of the structure shown in FIG. 1.
Figure 5:
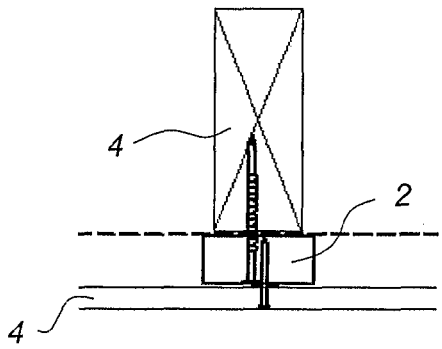
FIG. 5 is an enlarged sectional view showing the detail of an intermediate vertical connection of the structure shown in FIG. 1.

Referring to the drawings, an expressed joint panelised cladding system according to the invention is shown generally at 1.

The system 1 includes a plurality of battens 2 securable to an underlying building structure in the form of a frame 3 and a plurality of fibre cement cladding panels 4 having front and rear sealed surfaces 5 and 6 respectively.

In the preferred form, the battens 2 are in a simple strip form and have a frame engaging surface 7 and an integrally formed finish-ready panel supporting surface 8. In use, the exposed portion of this surface 8 forms an external recessed surface of an expressed joint as shown in the drawings. The battens 2 are preferably made from a medium to low-density nailable fibre cement which is either sealed on at least the finish-ready surface 8 or has a composition that makes the outer surfaces inherently weather resistant and finish-ready. Desirably the density is in the range 0.8 to 1.3 g/cc and more preferably 0.8-1.2 g/cc. Preferably, the batten material is formulated to meet the requirements of Australian Standard AS/NZS 2908.2:2000 relating to Type A external sheets, or similar. In preferred forms the fibre cement batten composition includes density modifiers such as: inorganic hollow or foamed microparticles (see for example WO 01/68547); calcium silicate hydrate; entrained air and other suitable density reducing additives, or any combination thereof.

It should be noted that while the form of batten illustrated has a flat frame engaging surface 7, this surface and/or the main body of the batten could have ridges or functionally equivalent formations that would allow fluid flow therethrough if required. This is particularly useful where the battens are to be secured horizontally and can also facilitate additional ventilation when mounted in other orientations.

The preferred battens have a thickness of at least 18-19 mm and a width of between 45 mm and 70 mm. These are ideally constructed from a medium to low density fibre cement that has density modifying additives in the form of spherical inorganic hollow microparticles such as those described in patent application WO 01/68547. The batten minimum thickness ensures sufficient fastener holding power to enable the cladding panels to be secured to the battens without the need to fix through to the underlying building structure. This thickness of batten also provides an air gap of sufficient depth to act as an effective insulating barrier to resist heat transfer and increase the overall "R" value rating of the structure.

The cladding panels 4 are preferably made from a medium density nailable fibre cement, which is at least partially weather resistant on it's front and rear faces. In the preferred form the panels are coated on all six sides using a radiation curable sealer. Ideally, these panels also meet the requirements of AS/NZS 2908.2:2000 or similar standard. In preferred forms the fibre cement panel composition includes density modifiers such as: inorganic hollow or foamed microparticles (see for example WO 01/68547); calcium silicate hydrate; entrained air and other suitable density reducing additives, or any combination thereof.

Also forming part of the preferred form of the system are optional backing strips 10. In one form, the strip is made from thin gauge metal or polymeric material and has an outwardly protruding ridge 11 along the joint region as shown that spans between the battens forming the backing of an expressed joint in the same plane as the batten surface 8.

The starting structure before the installation of the expressed joint facade system should be typical of the state ready for conventional cladding installation. This preferably includes the installation of a drainage plane 12, which most commonly comprises a pliable building membrane or moisture barrier such as a sarking, building wrap or building paper. For example, the requirements of suitable building membranes and underlays for use in Australia is set out in AS/NZS 4200.1:1994. However, rigid barriers could also be used.

Figure 6:
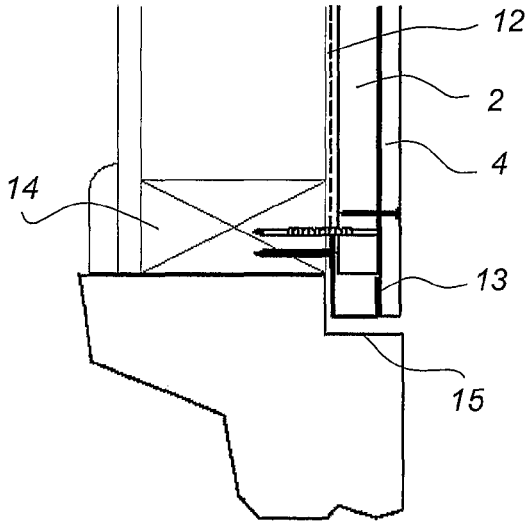
FIG. 6 is an enlarged sectional part view illustrating a slab edge arrangement.

Optionally, a vent strip 13 is then installed at the bottom of the framing base plate 14 adjacent the concrete slab 15 which may be rebated (as shown) or square, with the edge of the bent strip level or slightly lower than the bottom of the framing as shown in FIG. 6. This is preferably done prior to the installation of the battens 2.

In this next step, the fibre cement battens 2 are fastened to the sub-framing in the position shown in the drawings. The sub-frame is generally framing timber but can be other framing materials such as steel. Fastening into timber framing is done with nails, preferably 65 mm galvanised ring-shanked flathead nails. Fastening into steel framing may be done with screws, preferably 40 mm long HardiDrive screws or similar self-driving screws with corrosion-resistance. Of course, any suitable fastener or securing means may be used to secure the battens 2 to the sub-framing.

The vertical battens 2 are positioned to coincide with vertical joint positions, plus any necessary intermediate support positions. The vertical battens are usually positioned on vertical framing members and the layout of vertical joints are designed to coincide where possible, but if no framing member is available then auxiliary framing members can be added to the sub-frames to support the batten.

Figure 8:
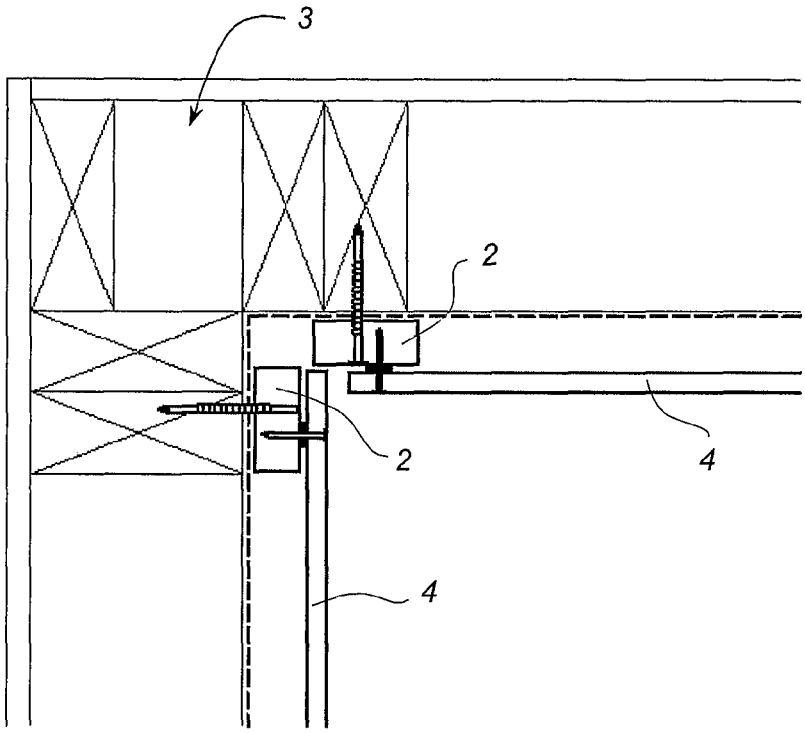
FIG. 8 is an enlarged sectional part view showing an internal corner fixing arrangement.
Figure 9:
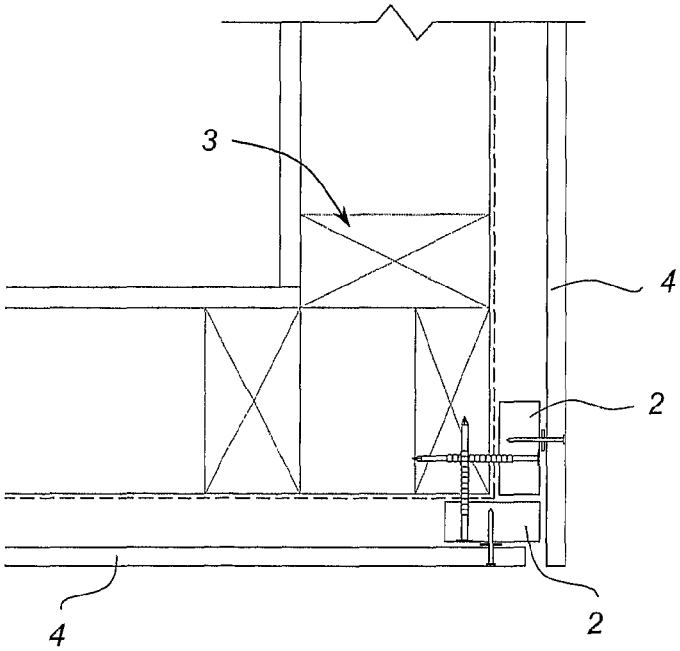
FIG. 9 is an enlarged sectional part view showing an external corner fixing arrangement.

Battens can also be used to form internal and external expressed corner joints as shown in FIGS. 8 and 9. The battens may also be used to form the joint between vertical and horizontal surfaces or junctions to form an expressed joint at the junction, or just to support the horizontal edge. Where horizontal battens are used, it is preferable to provide ventilation through or around the batten as good building practice for moisture control in building envelopes. This can be done by means of leaving suitable gaps, or using battens having ventilation passages formed therein, usually on the rear frame engaging surface of battens.

Figure 7:
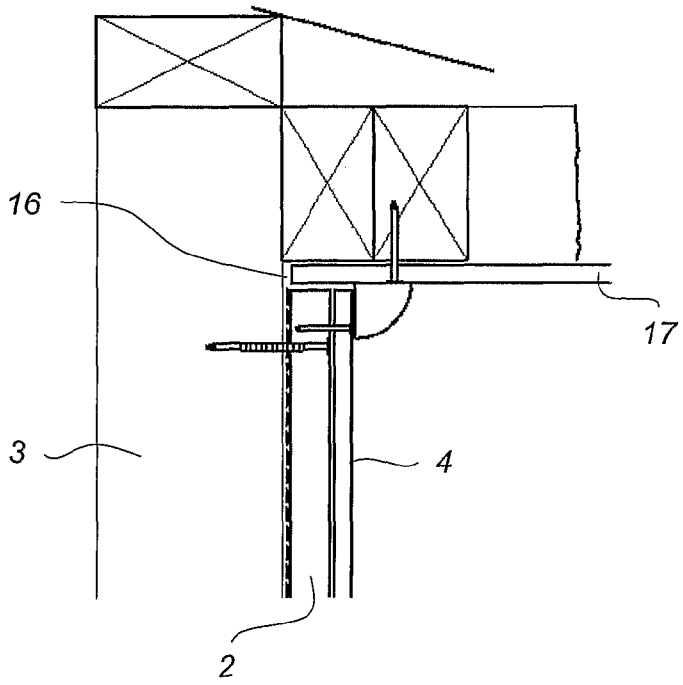
FIG. 7 is an enlarged sectional part view of an eave wall arrangement.

Positioning of the battens adjacent eave to wall corners can be straightforward as shown in FIG. 7 with a small gap 16 being left above the batten 2 (and cladding panel 4) to allow location of the eave sheet 17 as shown. Ventilation through the framing above the eave sheet can also provide venting to the roof space and via a roof vent to the outside of the building. This passage of air can be provided by framing provisions such as packers, grooves at the back of the eave framing, gaps in the eave framing against the wall framing or drilled holes in the eave framing.

If installed without a gap at 16, the wall cavity can be closed at the cladding/eave sheet junction or vented to allow passage of rising hot air to pass to the outside of the building at the eave level.

Figure 10:
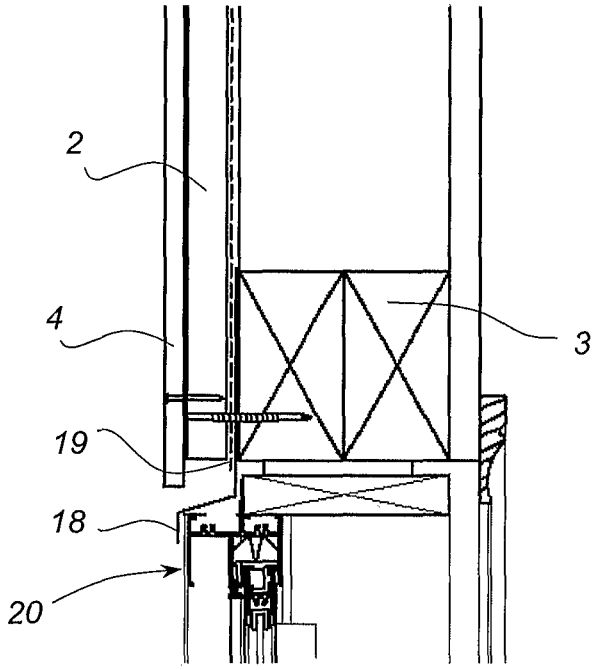
FIG. 10 is an enlarged sectional part view showing a window head arrangement.
Figure 11:
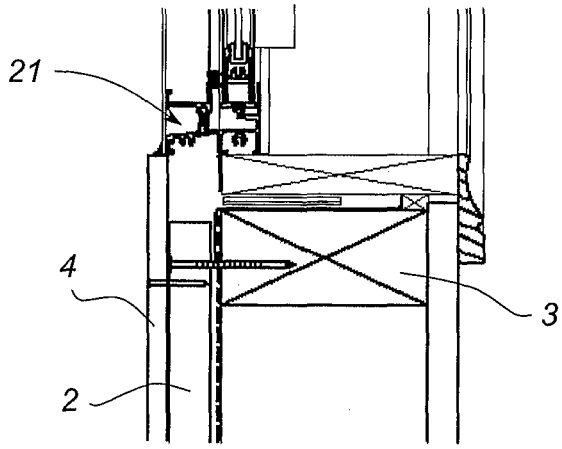
FIG. 11 is an enlarged sectional part view showing a window sill arrangement.

Setting adjacent window heads and sills is similarly very simple as shown in FIGS. 10 and 11. In the illustrated window head arrangement, the upper end of the flashing 18 is inserted behind the sarking 19 and the batten 2 is then screwed over the flashing and sarking by fastening through to the sub frame 3. The lower part of the flashing 18 then extends over the window head 20 in the usual manner. With the sill arrangement, the batten thickness is such that the sill 21 simply sits on, and is sealed against, an upper edge of the panel 4. In other variations the panel can be fitted inside, rather than abutting the outer window flange depending on either the window flange size and width or the position of the window in the opening.

Once the battens 2 are fastened to the sub-framing 3, the first panel 4 is installed, preferably the bottom corner panel, from which subsequent panels are spaced. Where the use of backing strips 10 is required, these are usually pre-connected to the panels, ideally using double sided adhesive tape. The panel is usually fixed level and plumb, but can be angled to produce an unusual architectural look if the framing and battens are set up to suit. The panels are fixed to the battens with screws or nails. Typical nails used are 30 mm×2.8 mm diameter galvanized fibre cement nails, but more suitable for ease of installation is the use of corrosion-resistant finishing nails, T-head nails or brad nails that are quickly and easily installed by nail guns which, when the nail gun is set to leave the nail flush with the surface, need no patching prior to painting. An example of a suitable gun is the "Paslode Impulse 250 II Bradder". A typical brad nail used is a "Paslode" 25 mm long stainless steel or galvanised "Paslode" C1 or ND brad, Typical screws for attaching panels to battens 2 include various panhead, waferhead, countersunk and hexagon head screws, typically 25 mm long and 8 or 10 gauge. The selection of screw will depend on the desired finish and whether the fasteners are intended to be concealed.

Other alternate fixing methods to attach the panel to the battens are with adhesive or double-sided tape. A typical adhesive is James Hardie Joint Sealant (JHJS) or a moisture polyurethane or hot melt adhesive, but other adhesives can also be used. Preferably the adhesive is applied as a continuous bead and also serves the dual function of sealing the panel top and side edges and optionally also the bottom edge. A typical example of a double-sided tape suitable for use to connect backing strips to panels and panels to battens is 3M™ or VHB™ double-sided tape, preferably 0.5 mm to 2 mm thick and 5 mm to 30 mm wide. However, other double-sided tapes can be used.

Any combination of fastener and adhesive or fastener and double-sided tape can be used to supplement attachment to either reduce the number of fasteners visible, or that need patching, or to achieve the necessary wind load resistance.

If adhesive has not been used as the whole or partial means to attach the panel to the battens, then preferably a sealant is used to seal the panel top and side edges and optionally the bottom edge between the panel edge and the batten or horizontal backing strip.

Once the first panel is secured, further panels are attached to the battens by maintaining or offsetting the alignment of the first panel and attaching in a similar fashion to the previous panel. The gap between the panels is typically 0 to 20 mm, but is preferably about 10 mm to express the joint to be visible when approaching the building and is usually in a predetermined configuration and pattern. The means of fixing, adhering and sealing are then repeated as described above. As shown, it is the exposed strip of the integral panel supporting surface of the batten that forms the external recessed surface of the expressed joint.

Where countersunk screws or punched nails are used to fasten the panels 4 to the frame 3, patching compounds can be used to fill over the fasteners so that the holes are flush with the surface of the panels. The patching material is typically a two-part epoxy such as megapoxy P1 or Hilti CA125. Where the temperature is below 15° C., the use of Hilti CA 273 is preferred. The holes over the fasteners are filled flat or slightly proud of the surface of the panel. After the patching material is set, sanding of the patching may be necessary in some areas to blend the patch surface to the same surface as the surrounding panel.

Once all the panels are secured, the panels are finished in situ. Typically, this is achieved through applying a minimum of two coats of exterior grade paint. Where the surfaces of the expressed joints are to be coloured the same as the panels, this is usually done as a simple post-installation painting process when painting the panels. However, where the surfaces of the expressed joint are required to be in a contrasting colour such as black, the open edges of the joint may be pre-finished prior to installation or at least prior to painting the panels. For example, the edges of the panels can be painted in the required contrasting colour and the panel mounting surface 8 of the battens 2 similarly pre-painted at least along a generally centrally located region where the defined joint will be positioned.

The advantages of this system over the prior art are numerous. For example, the provision of simple strip-like battens that also integrally provide the exposed recessed external surface at the base of the expressed joint simplifies the entire system. In prior art systems that utilise complex metal "top hat" style mounting battens or use wood battens and require a further seal component between the panel and the batten, it was necessary to provide two widths, one complex wide member used to support the panels and form the expressed joints and a narrower more simple section for use as intermediate support. By contrast, the preferred form of the present system allows the use of one batten size and shape of preferably 18 to 19 mm thick and approximately 50 to 70 mm in width for all applications. This is enabled by the solid material nature of the preferred batten which allow close fastener spacing and the fact that no spaced apart mounting flanges are required. Similarly, no separate complex corner battens or window or door opening supports are required, the simple battens of the invention being readily adaptable to such applications as shown, for example, in FIGS. 7 to 11.

Another advantage relating to the batten thickness of the preferred embodiment is that conventional domestic market windows can still be used without the need for complex setting, as the overall frame to outer surface distance is comparable to other cladding systems. By contrast, most of the other expressed joint systems using top hat battens and the like require either the use of more expensive commercial windows which accommodate a larger overall cladding depth or extra finishing and setting work if domestic windows are used. The preferred thickness of 18-19 mm also provides an effective insulating air gap between the building structure and the cladding panels.

Furthermore, the majority of prior art systems require the use of separately manufactured sealing components that are located intermediate the outermost surface of the battens and the rear surfaces of the cladding panel system. In some cases, these sealing components comprise separate metal or polymeric strips with integrally attached gasket-type elements, and in other cases comprise separate strips of compressible sealing material that can be made of any number of suitable materials. However, in the system according to the invention, the battens have an integrally formed finish-ready panel supporting surface which, in use, forms an exposed surface of the expressed joint formed thereon. Sealing, if required, is achieved either by means of the adhesive, that may optionally be used to secure the panels to the battens and backing strips (where used), or by use of a manually applied spreadable sealant which can be applied after the panels are installed and which in any event are required for use with most of the prior art systems in addition to the other sealing mechanisms provided.

In the preferred form of the invention where brad nails or other finishing nails are used to secure the fibre cement panels to the battens, there are also significant savings in terms of mounting and finishing the panels. Firstly, the use of finishing nails means that there is no pre-drilling of the cladding panels, as has been required in many of the commercial systems, and secondly, high speed nail guns can be used. Most importantly, careful use of finishing nails can obviate the need for any filling or patching prior to painting.

In embodiments of the system utilising the preferred thick section nailable fibre cement batten, even further advantages are conferred arising from the dimensional stability of the batten material and the fact that by using like materials for the batten and the cladding panels, issues relating to differing thermal coefficients of expansion and the like are unlikely to adversely affect the integrity of the panel to batten connection. Accordingly, problems such as fasteners "popping" or loosening in other modes are substantially eliminated or at least significantly reduced.

Another advantage of the preferred form of the present invention is that by using a relatively solid batten having good fastener holding properties, there is no need for the panel to be anchored back to the framing. This also potentially facilitates the use of smaller, less expensive fasteners than some of those used in the prior art.

While some of the advantages discussed above relate to the preferred use of nailable fibre cement as the batten material, the use of appropriately treated timber battens is also contemplated by the invention, as many of the advantages of the system relating to its simplicity and ease of installation are still achieved with this material. Similarly, battens of other, preferably nailable, materials such as polymeric materials or various nailable composites, are also considered to fall within the scope of the invention. The invention also contemplates the use of thin section battens wherever the panels are anchored by fasteners extending through these and into the underlying building structure, with significant advantages still arising from the simplified batten defining the recessed surface of the expressed joint.

It should also be appreciated that whilst the preferred embodiment described is a system adapted for securement to a building structure in the form of a building frame most preferably of timber, it can easily be adapted for use with other building structures including those made of masonary and/or concrete.

Accordingly, it can be concluded that while the invention has been described in relation to preferred embodiments; the invention can be embodied in many other forms.

The invention claimed is:

1. An expressed joint panelized cladding system comprising:

a plurality of battens fastened to a building structure, wherein each of the battens is made of low density fiber cement and has a flat and elongate contour, wherein at least one batten having a structure engaging surface and an integrally formed finish ready panel supporting surface, wherein the structure engaging surface and the integrally formed finish ready panel supporting surface are opposing parallel faces of the batten; and at least one or more fiber cement cladding panel secured directly to the at least one batten wherein the batten is interposed between the building structure and the fiber cement cladding panel such that said fiber cement cladding panel covers a substantial portion of said batten from view leaving a portion of said finish ready panel supporting surface exposed, wherein said exposed finish ready panel supporting surface of the batten forms an external recessed surface of an expressed joint.

2. The expressed joint panelized cladding system according to claim 1 wherein the fiber cement cladding panels have sealed front and rear surfaces.

3. The expressed joint panelized cladding system according to claim 1 wherein the at least one batten is made from a non-metallic nailable material.

4. The expressed joint panelized cladding system according to claim 1 wherein the at least one batten is of sufficient thickness and has sufficient nail holding properties to fasten the at least one batten to the underlying building structure using appropriate fasteners, with the at least one fiber cement cladding panel being supported solely by attachment to the at least one batten.

5. The expressed joint panelized cladding system according to claim 1 wherein at least one fiber cement cladding panel is secured by means of fasteners that extend through the at least one batten and into the building structure.

6. The expressed joint panelized cladding system according to claim 1 further comprising a plurality of thin backing strips, each having a protruding central ridge, wherein the plurality of thin backing strips create a sealable external recessed surface of an expressed joint along edges of panels that are not aligned with the at least one batten.

7. The expressed joint panelized cladding system according to claim 1 wherein the majority of the plurality of battens are secured vertically to the building frame structure.

8. The expressed joint panelized cladding system according to claim 1 wherein the at least one batten is secured horizontally using additional framing support where required and further battens or backing strips are used to define additional joint surfaces as required.

9. The expressed joint panelized cladding system according to claim 1 wherein the cladding panels are secured to the at least one batten using small head finishing nails, T-head nails, or brad nails.

10. The expressed joint panelized cladding system according to claim 1 wherein the panels are secured to the at least one batten using an appropriate form of adhesive system.

11. The expressed joint panelized cladding system according to claim 1, wherein the batten has a thickness of at least 18 mm and a width of about 40 mm to 100 mm.

12. The expressed joint panelized cladding system according to claim 1, wherein the batten has a thickness of at least 18 mm and a width of about 45 mm to 70 mm.

13. The expressed joint panelized cladding system according to claim 1, wherein the batten comprises a longitudinal nailable fiber cement strip, wherein the fiber cement strip comprises fiber cement having a density range of about 0.8 to 1.3 g/cc.

14. The expressed joint panelized cladding system according to claim 13, wherein the fiber cement has density range of 0.8 to 1.2 g/cc.

15. A method of constructing an expressed joint panelized clad wall, said method including the steps of:

erecting a building structure;

fastening a plurality of battens to the building structure having a frame, wherein each batten comprises a flat and elongate strip of a nailable material, at least one batten having two parallel surfaces comprising a structure engaging surface and an integrally formed finish ready panel supporting surface, wherein each batten is attached to the building structure in a manner such that the structure engaging surface—contacts—the frame of the building structure;

and securing at least one fiber cement cladding panels directly to the at least one batten;

whereby the one or more fiber cement cladding panels are positioned such that said fiber cement cladding panels cover said batten in a manner such that a portion of said finish ready panel supporting surface remains exposed, wherein said exposed finish ready panel supporting surface on at least one of said battens forms an external recessed surface of an expressed joint formed thereon.

16. The method according to claim 15 further comprising the step of connecting a drainage plane to the building structure prior to securing the battens.

17. The method according to claim 15 wherein the building structure comprises a frame made from timber and the battens are made of fiber cement.

18. The method according to claim 17 wherein the batten has a thickness of at least 18 mm and a width of about 40 mm to 100 mm.

19. The method according to claim 17 wherein the batten has a thickness of at least 18 mm and a width of about 45 mm to 70 mm.

20. The method according to claim 17 wherein the batten comprises a longitudinal nailable fiber cement strip, wherein the fiber cement strip comprises fiber cement having a density range of about 0.8 to 1.3 g/cc.

21. The method according to claim 17 wherein the fiber cement has density range of 0.8 to 1.2 g/cc.

22. The method according to claim 15 wherein the fiber cement cladding panels are nailable and are secured to or through the underlying fiber cement battens by means of finishing nails.

23. The method according to claim 15 further comprising the step of attaching backing strips along the horizontal edges of panels where there will be no underlying batten.

24. The method according to claim 23 wherein the fiber cement cladding panels have sealed front and rear surfaces and wherein the backing strip is pre-connected to the rear sealed face of the fiber cement panel.

25. The method according to claim 15 further comprising the step of installing a vent strip adjacent the base of the building structure.

* * * * *